US007754051B2

(12) United States Patent
Porco

(10) Patent No.: US 7,754,051 B2
(45) Date of Patent: Jul. 13, 2010

(54) ROLL CLEANING APPARATUS

(75) Inventor: Antonio Porco, Sault Ste. Marie (CA)

(73) Assignee: Superior Industrial Services, Sault Ste. Marie (CA)

( * ) Notice: Subject to any disclaimer, the term of this patent is extended or adjusted under 35 U.S.C. 154(b) by 48 days.

(21) Appl. No.: 12/265,755

(22) Filed: Nov. 6, 2008

(65) Prior Publication Data

US 2009/0056051 A1 Mar. 5, 2009

Related U.S. Application Data

(62) Division of application No. 11/037,517, filed on Jan. 19, 2005, now Pat. No. 7,465,374.

(30) Foreign Application Priority Data

Jan. 19, 2004 (CA) ..... 2456306

(51) Int. Cl.
*D21G 3/00* (2006.01)

(52) U.S. Cl. ..... 162/272; 162/199; 15/256.51

(58) Field of Classification Search ..... 162/272, 162/199; 15/256.51
See application file for complete search history.

(56) References Cited

U.S. PATENT DOCUMENTS 4,953,252 A 9/1990 Akisawa

*Primary Examiner*—Mark Halpern
(74) *Attorney, Agent, or Firm*—Joseph Conneely; McCarthy Tetrault LLP

(57) ABSTRACT

A paper making machine may having heated rolls for making high clay content papers. A roll cleaning apparatus may be mounted to the paper making machine. The roll cleaning apparatus may have a cleaning member that is mounted to a support member that extends lengthwise relative to a first roll of the paper making machine. The cleaning member may be a pad having a substantial area of the surface of the roll may be contacted. The cleaning member may be movable between an engaged position against the roll during operation, and a disengaged position spaced away from the roll in a non-operating condition, such as when replacement of the cleaning member is desired. The roll cleaning apparatus may include a drive connected to cause linear reciprocation of the cleaning member. The roll cleaning apparatus may have a drive or actuator mounted to move the cleaning member between the engaged and disengaged positions, and may be operable to bias the cleaning member against the roll in use.

21 Claims, 13 Drawing Sheets

ROLL CLEANING APPARATUS

This application is a divisional of U.S. patent application Ser. No. 11/037,517, filed Jan. 19, 2005, now U.S. Pat. No. 7,456,374 and incorporated herein by reference. This application claims priority from Canadian Patent Application No. 2,456,306, filed Jan. 19, 2004, and incorporated herein by reference.

FIELD OF THE INVENTION

The present invention relates to methods and apparatus for cleaning rolls.

BACKGROUND OF THE INVENTION

Many industrial processes use rolls to either treat or form a web of material. Typical of such applications is the papermaking process, in which, at various stages of the process the web of paper is passed between a nip or entrained about one or more rolls. During such a process, the rolls may pick up material from the web and thus contaminate the surface of the roll. Such contamination can lead to reduction in the quality of the process and may result in unsatisfactory material being produced.

It has previously been suggested to remove material from the roll by the application of a doctor blade against the roll surface. A doctor blade is a thin blade that scrapes the surface and removes the material. However, in practice it is found that the blade may not be effective to remove all the surface contamination and eventually the contamination will build up to impair the performance of the process. For example, in a papermaking process, it may be that rolls in a calendar stack are heated. Heating is sometimes used when papers of particular chemical compositions, such as, for example, relatively high clay or starch content and gloss finish are being produced. The warmth of the roll may tend to increase the tendency for clays, starch or other materials to build up on the rolls. In any case, it may be desirable to prevent or discourage the agglomeration of clays or other matter on the rolls.

SUMMARY OF THE INVENTION

In general terms, the present invention provides a pad that can engage the periphery of the roll over a limited extent of the circumference. The pad is formed with a scouring surface that may tend to remove contaminants from the surface. The pad is mounted on a support that can be pivoted into and out of engagement with the roll. The support is biased to provide a relatively uniform pressure of the pad against the surface of the roll and thereby to clean the surface.

In another feature, the scouring head may be pivotally supported to permit the pad to conform to the surface of the roll as it is brought into engagement. The support may be biased into engagement with the roll by a compressible fluid. In another feature, the pad may be caused to oscillate axially relative to the surface of the roll while the roll is turning.

In another feature, the apparatus has a cleaning member operable to engage the roll while the roll is revolving, and a carrier. The cleaning member is mounted to the carrier. The carrier is mounted to present the cleaning member to the roll. The cleaning member is movable between a first position in which the cleaning member engages the roll, and a second position in which the cleaning member is located clear of the roll. The cleaning member has a contact region having both axial and circumferential extent. The contact region is flexible in the radial direction. In another feature, the cleaning member has a roll contacting interface element, and the roll contact interface element is operable at temperatures in excess of 160 F. In a further feature, the cleaning member has a roll contacting interface element that is operable at temperatures in excess of 200 F, and which temperatures may be in the range of 250-300 F. In still another feature, the cleaning member is axially displaceable relative to the roll while in contact with the roll and while the roll is revolving.

In a further feature, the roll cleaning apparatus has a drive connected to impart reciprocating axial motion to said cleaning member. In yet another feature, the carrier is movably mounted relative to the roll, and is constrained to cause said cleaning member mounted thereto to move in a manner having a non-zero radial component of displacement relative to the roll. In a still further feature, the carrier is pivotally mounted, and is pivotally movable about an axis running parallel to said roll. In another feature, the cleaning member has a circumferentially extending surface conforming to the roll, and the cleaning member has a degree of freedom of motion permitting the circumferentially extending surface to self-center on the roll.

In another feature, the cleaning member includes a self-centering shoe. There is also a feature in which the roll cleaning apparatus includes a motion governor operable to move said cleaning member between said first and second positions. The roll cleaning apparatus includes a biasing member operable to urge the cleaning member against the roll. In another feature, the biasing member is mounted between the support member and a fitting that is rigidly positioned relative to the axis of rotation of the roll, and is operable to move the support member, and the cleaning member attached thereto, relative to the roll. In yet another feature, a drive is mounted to reciprocate the cleaning member axially relative to the roll. In a further feature, the biasing member employs a working fluid to urge the support to move. In another feature, the drive is an oscillator.

In another aspect of the invention, there is a paper making machine having a first roll and a second roll mounted in parallel and defining a nip therebetween. The first roll is a heated roll, having a temperature of greater than 160 F. The first roll has an axis of rotation. A web workpiece is mounted to run through the nip, the web workpiece having a non-trivial clay content. There is a roll cleaning apparatus for engagement with the first roll. The apparatus includes a cleaning member operable to engage the roll while the roll is revolving and a carrier. The cleaning member is mounted to the carrier. The carrier is mounted to present the cleaning member to the first roll. The cleaning member is movable between a first position in which the cleaning member engages the first roll, and a second position in which the cleaning member is located clear of the first roll. The cleaning member has a contact region having both axial and circumferential extent. The contact region is flexible in the radial direction relative to the axis of rotation of the first roll. The paper making machine further includes a second roll cleaning apparatus.

In another feature of that aspect of the invention, the first and second roll cleaning apparatuses are mounted to engage the first roll on opposite sides of the nip. In a further feature, at least the first roll cleaning apparatus has a drive connected to cause axial reciprocation of the cleaning member while the first roll is revolving. In another feature the first roll cleaning apparatus includes an actuator operatively connected to urge the cleaning member against the first roll.

BRIEF DESCRIPTION OF THE DRAWINGS

These and other features and aspects of the invention may become more apparent upon a reading of the following detailed description of examples embodying those features and aspects in which reference is made to the appended drawings of which.

DETAILED DESCRIPTION

Figure 1B:
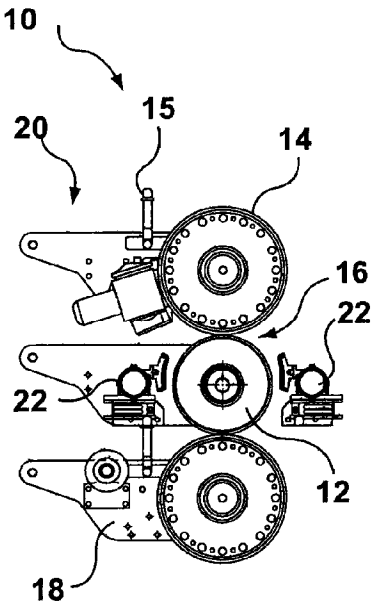
FIG. 1*b* is an end view of the roll assembly of FIG. 1*a;*
Figure 1A:
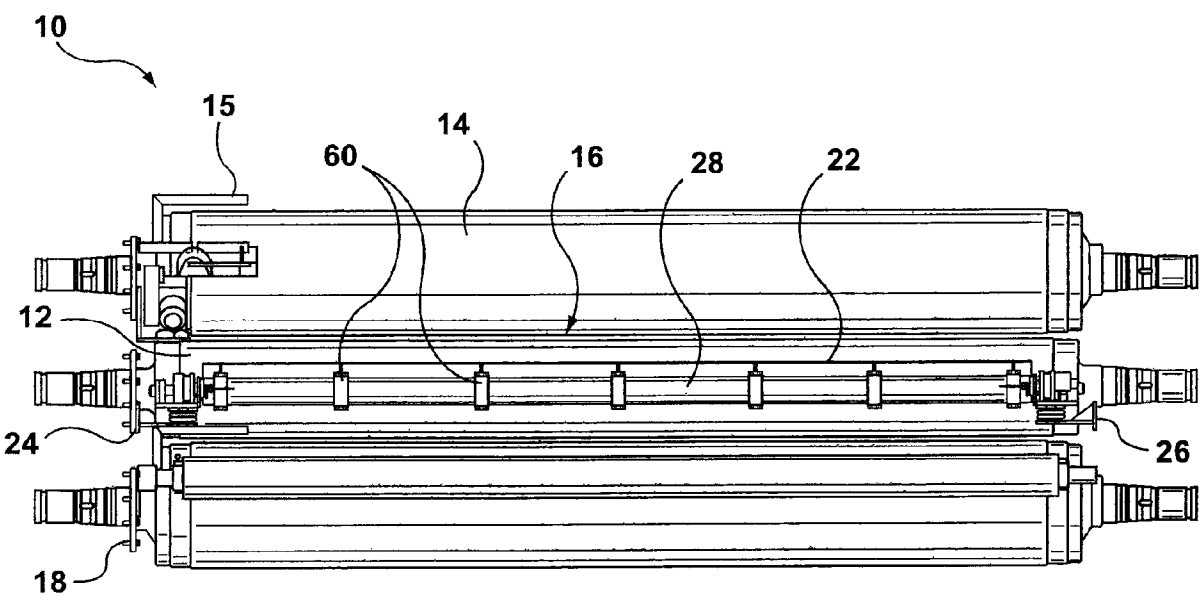
FIG. 1*a* is a general arrangement view in elevation of a roll assembly of a paper making machine.

The description that follows, and the embodiments described therein, are provided by way of illustration of an example, or examples, of particular embodiments of the principles of aspects of the present invention. These examples are provided for the purposes of explanation, and not of limitation, of those principles and of the invention. In the description, like parts are marked throughout the specification and the drawings with the same respective reference numerals. The drawings are not necessarily to scale and in some instances, proportions may have been exaggerated in order more clearly to depict certain features of the invention.

In the description that follows, reference may be made to papermaking machines, to calendar stack, and to rolls for calendar stacks of paper making machinery. The construction and operation of such machines may a involve rolls, and fittings for operation in co-operation with rolls. In that regard, a frame of reference may be defined in terms of a polar cylindrical co-ordinate system. Roll may have the general form of a body of revolution of constant radius formed about a central axis. This body of revolution may be considered as having a long axis, or axial direction, which may be termed the z-axis, that is concentric with the roll; a radial direction or radial axis, r, extending away from the z axis; and a circumferential direction mutually perpendicular to the axial and radial directions, referenced from an angular datum. Similarly, other fittings for co-operation with the roll, or rolls, may pivot about axes parallel to the long axis, and may move in translation parallel to the long axis.

Referring to the drawings, a papermaking machine may include a calendar stack, such as may be indicated generally as 10. Calendar stack 10 may have a pair of rolls 12, 14 defining a nip 16. A web passes through the nip 16 as part of the papermaking process. Papermaking machine 10 has support frames 18 that support the ends of rolls 12 and 14. Support frames 18 may be mounted to a foundation, and that may be taken as providing a fixed datum for the location of other fittings. Roll 12 may be provided with a heating apparatus, such that the surface of roll 12 may be maintained at a temperature that is above the temperature of the surrounding room generally. Roll 12 may be heated to relatively high temperatures such as may be in the range of about 150-300 F, or more narrowly, 230 to 300 F. In some instances roll 12 may be heated with steam or oil for extended periods of operation at greater than 250 F. Roll 12 may be employed with a web workpiece, 20, that may be a paper web, during a stage of manufacture of that web workpiece. Web workpiece 20 may be a paper web, and may be a paper web having a non-trivial chemical content, whether of clay, starch or some other chemical. It may have a moderate or high starch or clay content, such as may be employed in making highly glossy surface finishes in coated paper or may be a calendared, or super-calendared paper. Calendar stack 10 may also have one or more web breakage sensors 15 mounted to it, the web sensor typically being an electric eye having a transmitter and a receiver or reflected cantilevered out to bracket the web path. When the optical signal is made, the automatic control system for the calendar stack, and for the paper making machine more generally, may infer that there is no web in place. The absence of a web may be due to a breakage of the web, and the machine may be caused to stop, usually relatively quickly. In normal operation, the feed rate of the paper making machine may be of the order of 2000-3500 feet per minute (fpm) at calendar stack 10.

A roll cleaning apparatus, or assembly, is indicated generally as 22. Assembly 22 may tend to extend longitudinally, generally parallel to the long axis of rolls 12, 14. To this end, assembly 22 may be mounted to support frames 18, or to a base that is fixed in position relative to frames 18, and hence relative to the centerline axis of roll 12 of papermaking machine calendar stack 10, such that the radial position of assembly 22 may be known. Assembly 22 may span the full width of papermaking machine calendar stack 10.

Assembly 22 may be a mechanical contact cleaning apparatus, and may be a roll scrubber. Assembly 22 may include stationary base members, such as may be in the nature of a pair of first and second, or left and right hand mounting fittings identified as brackets 24, 26, whose position is rigidly fixed with respect to support frames 18 (to which they may be mounted, as for example by bolted fittings. A support member in the nature of a longitudinally extending carrier 28 may be mounted to extend between brackets 24, 26. Brackets 24, 26 are similar to each other in design. Each may include a stationary member, such as may be identified as a base plate 30.

A movable member, such as may be a plate 32, may be movably secured to the stationary member, namely plate 30, to permit objects mounted thereto to have a displacement that includes a component of motion in the radial direction relative to the long axis of roll 12. In one embodiment, this securement may be in the nature of a pin 34, such that when installed the relationship is that of a hinge or pivot whose axis is parallel to the long axis of roll 12, so that plate 32 has an angular degree of freedom relative to plate 30. An actuator, or biasing member, may be mounted to urge or cause motion between the movable member and the stationary member. By way of example, the actuator may be an hydraulic or pneumatic actuator, such as may be exemplified by a pneumatic bellows 36 located between the stationary and movable plates 30, 32 and may be operable to govern pivotal movement about the pin 34.

Figure 2B:
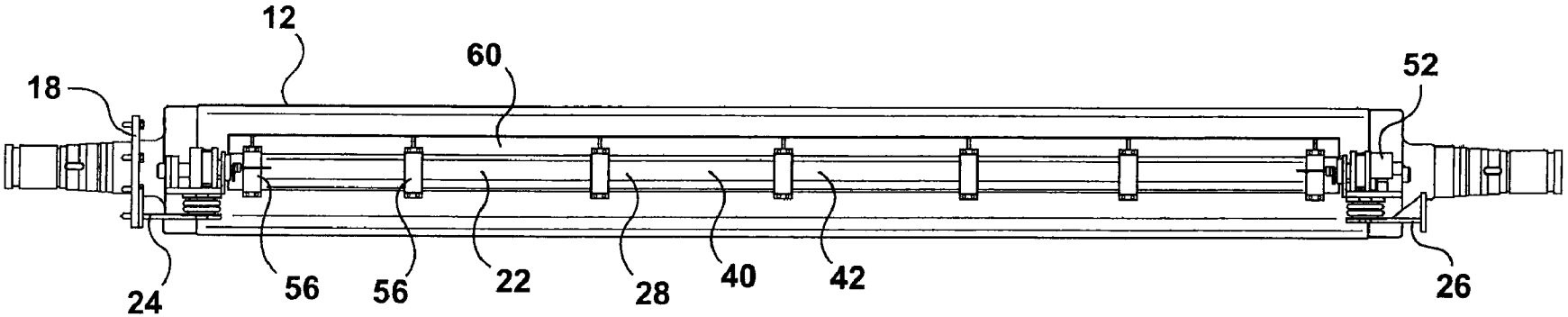
FIG. 2*b* shows an elevation view of the roll assembly of FIG. 2*a;*
Figure 2A:
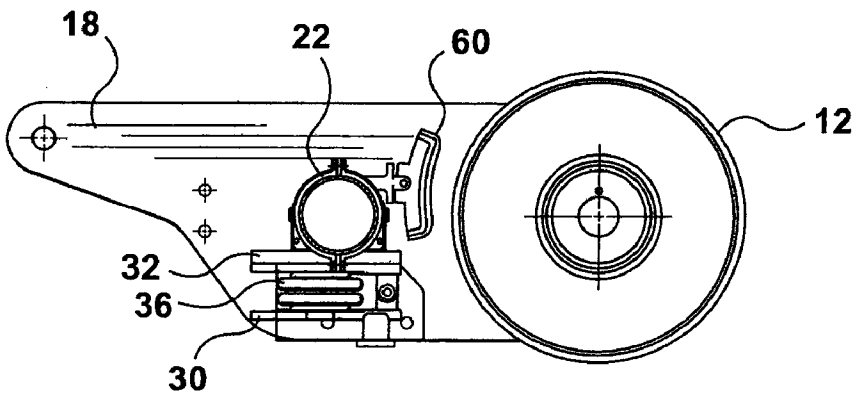
FIG. 2*a* is an end view of a portion of the roll assembly of FIG. 1*a* showing the relative location of a roll cleaning apparatus.
Figure 2C:
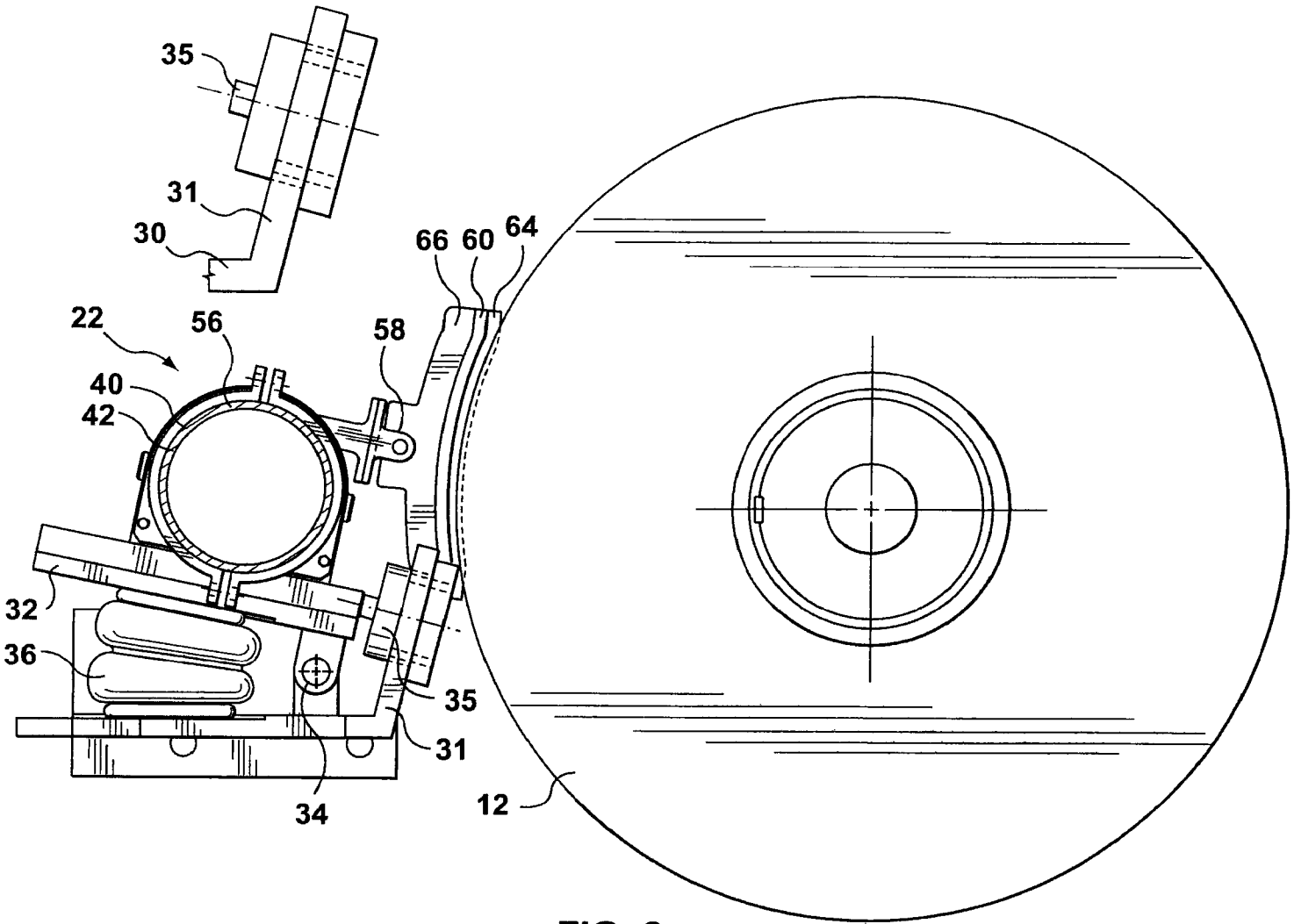
FIG. 2*c* is an enlarged detail of FIG. 2*a;*
Figure 3C:
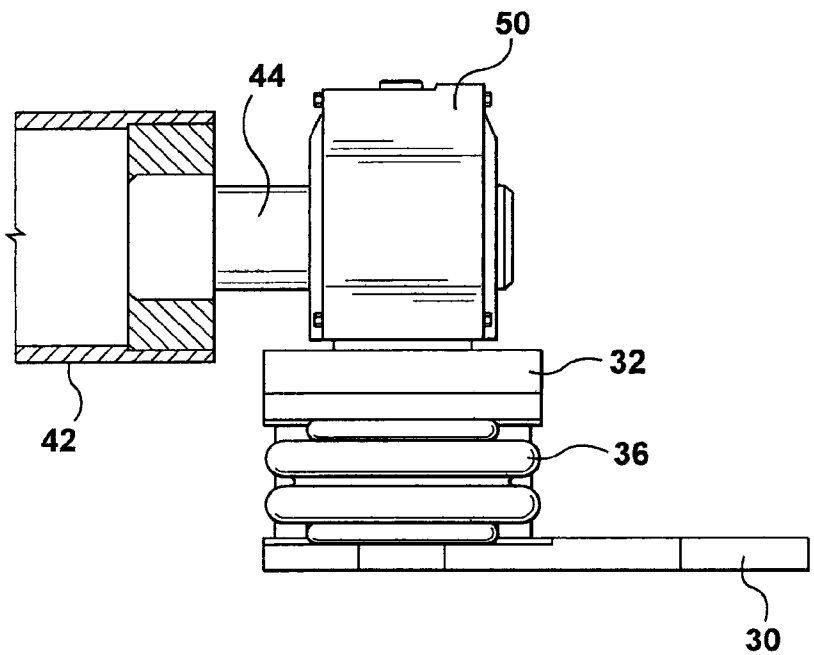
FIG. 3*c* is a partially sectioned enlarged detail of the cleaning apparatus shown in elevation in FIG. 3*a;*
Figure 3A:
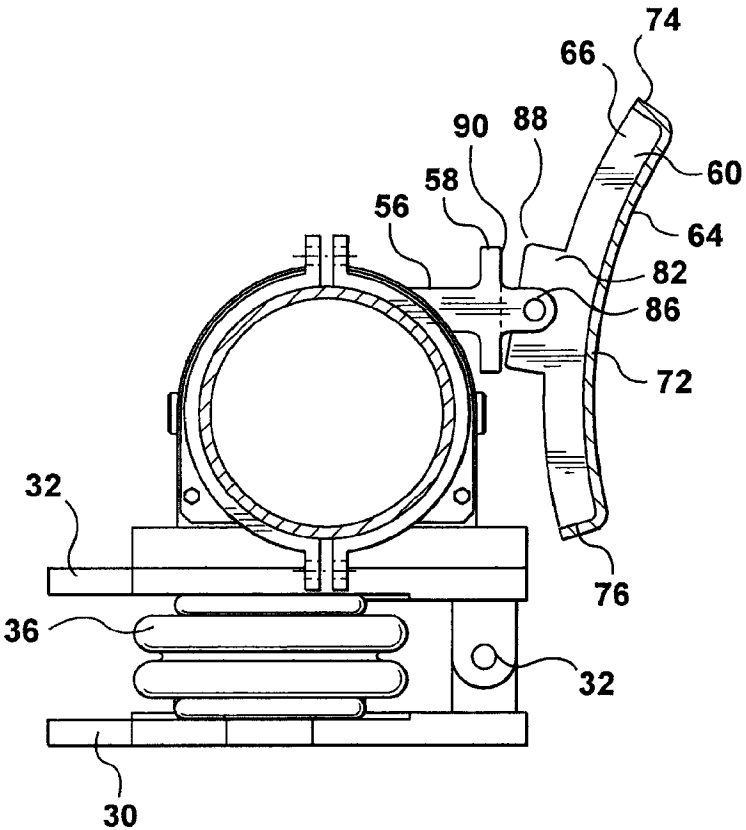
FIG. 3*a* is an end view of the cleaning apparatus of FIG. 2*a;*
Figure 3B:
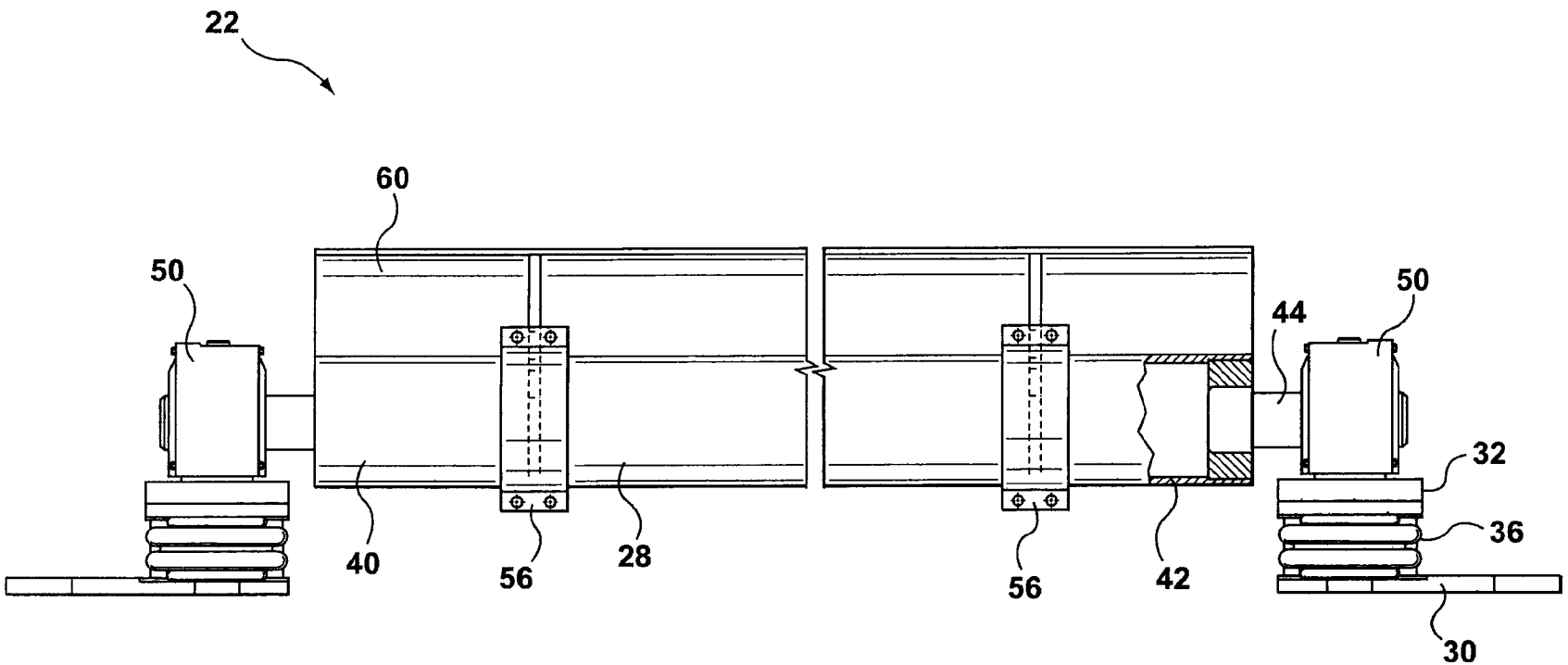
FIG. 3*b* is an elevation view of the cleaning apparatus of FIG. 3*a;*

A second, or opposing actuator, or biasing member, or counterbalancing member 35, may be mounted, such as to plate 30 or an extending arm 31 thereof, in opposition to the first actuator, exemplified by bellows 36. Counterbalancing member 35 may also be a pneumatic cylinder. The pressure in bellows 36, when activated, may be maintained at a certain differential over the pressure in counterbalancing member 35, such that the net resultant force acting to rotate carrier 28 may tend to be relatively small. For example, where the pressure in bellows 36 may be 50 to 60 psia, the pressure in the cylinder of counterbalancing member 35 may be 40 or 50 psia, giving a constant pressure differential of 10 psi. (+/−). Assembly 22 may be in relatively close balance relative to pin 34, with the static condition being such that the weight of assembly 22 is distributed to cause assembly 22 to move away from roll 12 in the default, or shut down, condition when no pressure is available in bellows 36 or counterbalance cylinder 35. When bellows 36 is activated, the resultant imbalance may be sufficient to urge the scrubbing member (described more fully below) against roll 12. This may occur when the calendar stack automatic control senses a web speed greater than a suitable threshold value, be it 600 fpm, 1000 fpm, or some other value which may be in a range such as 500-1500 fpm, that may be below the customary full operating speed of calendar stack 10 more generally. The engagement pressure on the footprint of assembly 22 against roll 12 may be comparatively soft. It may be less than 0.1 psi, or, alternatively, may be less than 1" water gauge. As bellows 36 is activated, the torque applied may tend to move assembly 22 in a forward, or engagement, direction into engagement with roll 12 relatively slowly. By contrast, should a paper breakage be sensed by one of sensors 15, the automatic electronic control may cause pressure to be dumped from bellows 36 very quickly, resulting in a strong force (and consequently moment, or torque) imbalance tending to move assembly 22 in a rearward, or disengagement direction to a position away from roll 12 more quickly, if not much more quickly (i.e., in the counter-clockwise direction relative to pin 32 as viewed in FIGS. 2*c*, 3*a* and 4*a*, for example).

Apparatus 22 may include a motion limiting, or range of motion defining member, such as an abutment or stop 38. Stop 38 may be adjusted to inhibit movement of the movable member, namely plate 32 beyond a predetermined motion end position in the forward or engagement direction (clockwise in FIGS. 2*c*, 3*a* and 4*a*). Apparatus 22 may also include a stand-off, or rest, 39, that limits motion in the direction (counter-clockwise in FIGS. 2*c*, 3*a* and 4*a*) away from roll 12 that may provide a support upon which to rest plate 32 (and the attached parts of assembly 22) when bellows 36 is not energized. Contact of plate 32 against stop 38 may generate a signal to the automatic control of assembly 22, or of calendar stack 10 more generally, as may be, to cause a maintenance annunciator signal to be provided to the operator. It may also cause assembly 22 to be moved away from roll 12. That is, the contact of plate 32 against stop 38 may be inferred as being due either to the absence of a roll interface engagement member of assembly 22, or it may be due to a need to replace a worn out roll interface engagement member. In either case, it may be appropriate to notify an attendant.

Carrier 28 may include a beam member 40. Beam member 40 may be of hollow section. In one embodiment, the beam of hollow section may have the form of a cylindrical shaft 42, which may be of circular section. Beam member 40 may have mounting fittings that permit motion between beam member 40 and movable plates 32. In particular, those fittings may permit a degree of freedom in linear translation, such as linear axial motion of beam member 40 relative to roll 12. To that end, beam member 40 may have longitudinally slidable guides, or ways, mounted at either end thereof. Those ways may be in the form of circular cylindrical stub shafts 44, or journals, machined and mounted at either end of the hollow shafting, to define trunnions. Those trunnions may be carried in bearings 50 and mounted in trunnion blocks 46, that are rigidly mounted to plates 32. Where stub shafts 44 are circular, beam member 40 may also tend to have an angular degree of freedom, namely the ability to move angularly about its own longitudinal axis. Rotation of the shaft 42, and hence the rotational degree of freedom, may be inhibited by a key 48 acting between the shaft 42 and trunnion block 46. The stub shafts 42 are supported in slide bearings 50 that support the tubular housing defined by the hollow section of beam member 40. Shafts 42 can slide axially relative to blocks 46 and bearings 50.

Figure 1C:
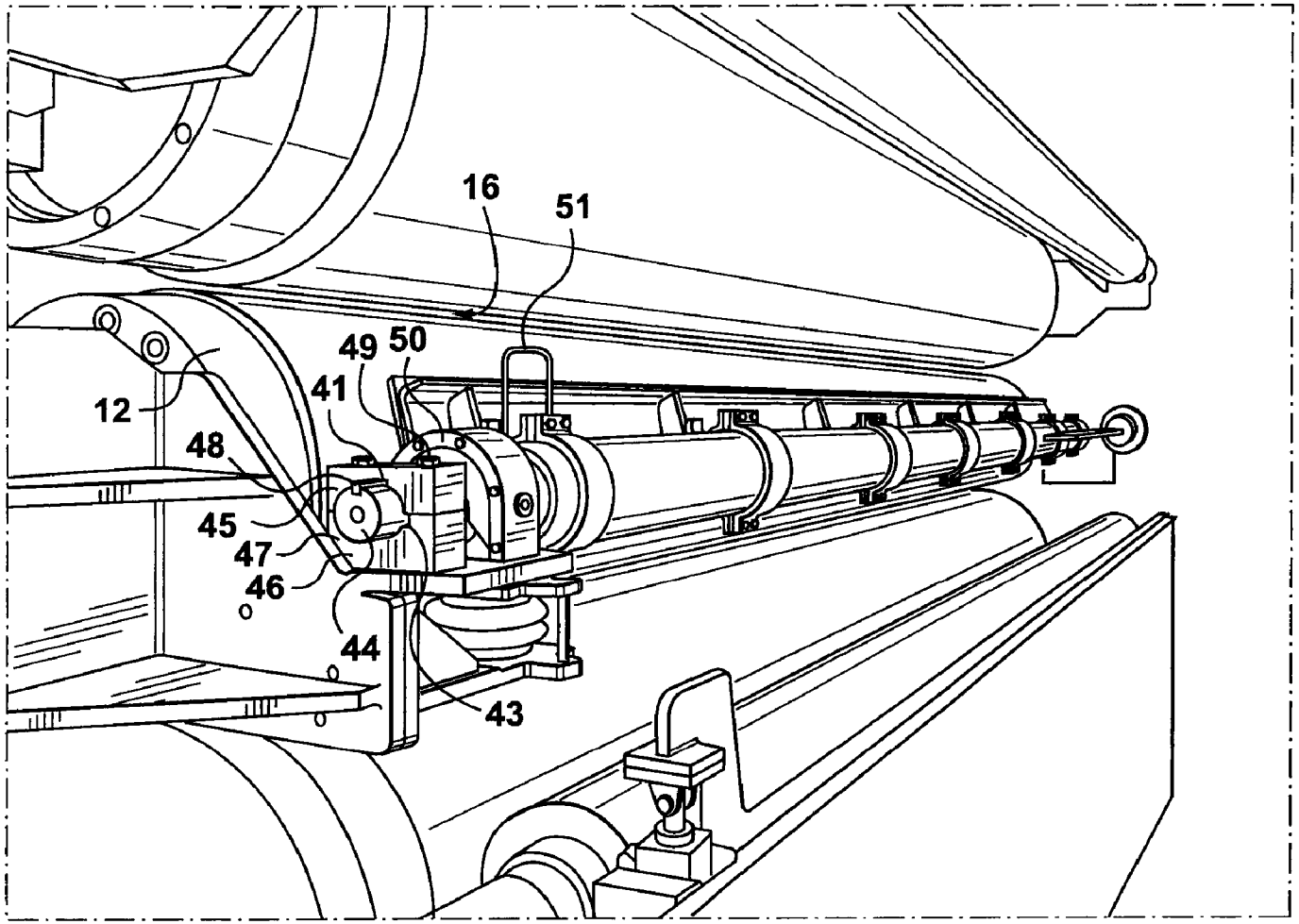
FIG. 1*c* is a general arrangement, perspective view of the roll assembly of FIG. 1*a*, taken from one end of the roll assembly in a paper making machine of FIG. 1*a;*
Figure 1D:
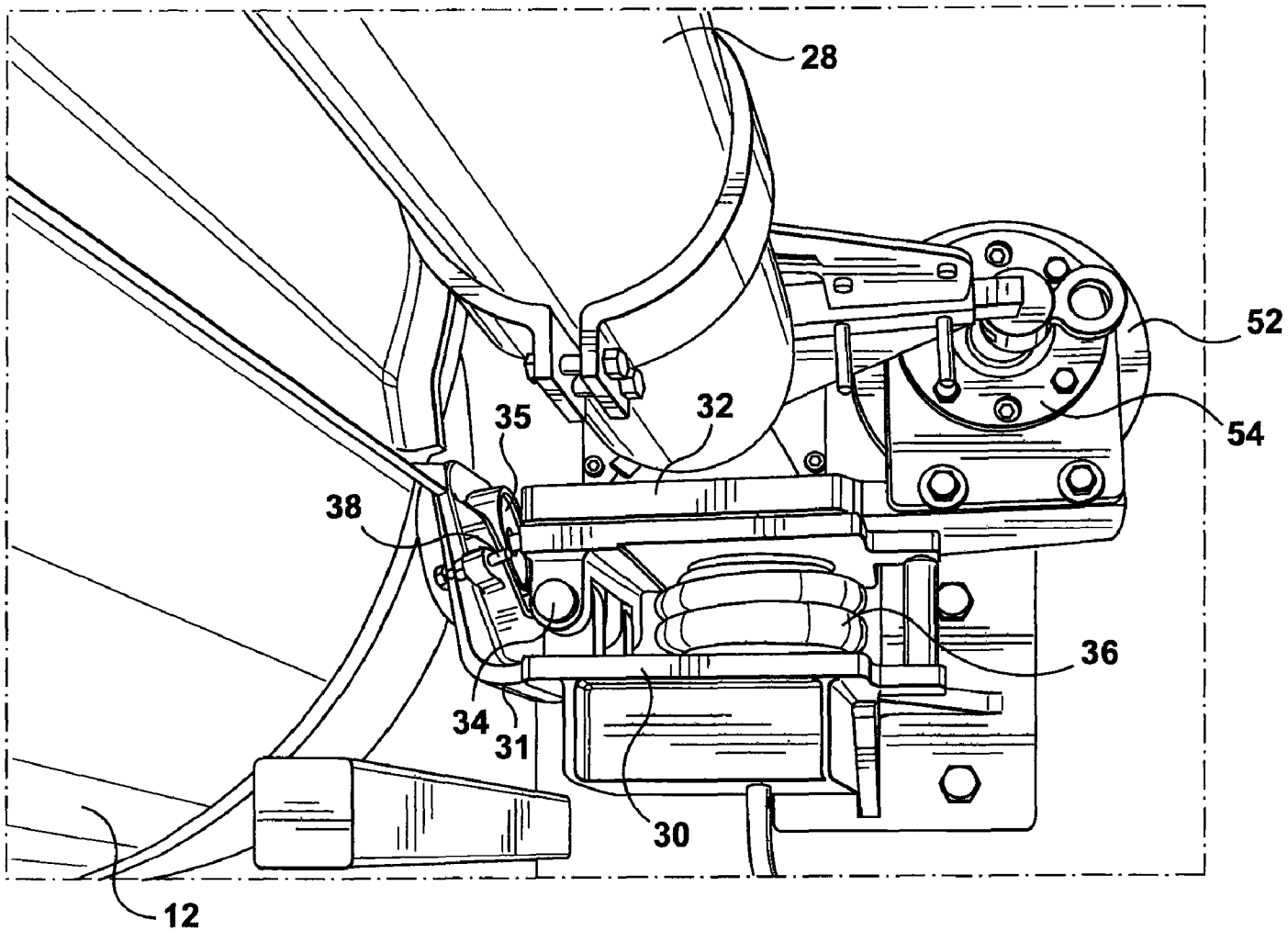
FIG. 1*d* is an enlarged perspective view of a detail of the far, or distal, end of the roll assembly shown in FIG. 1*c;*
Figure 1E:
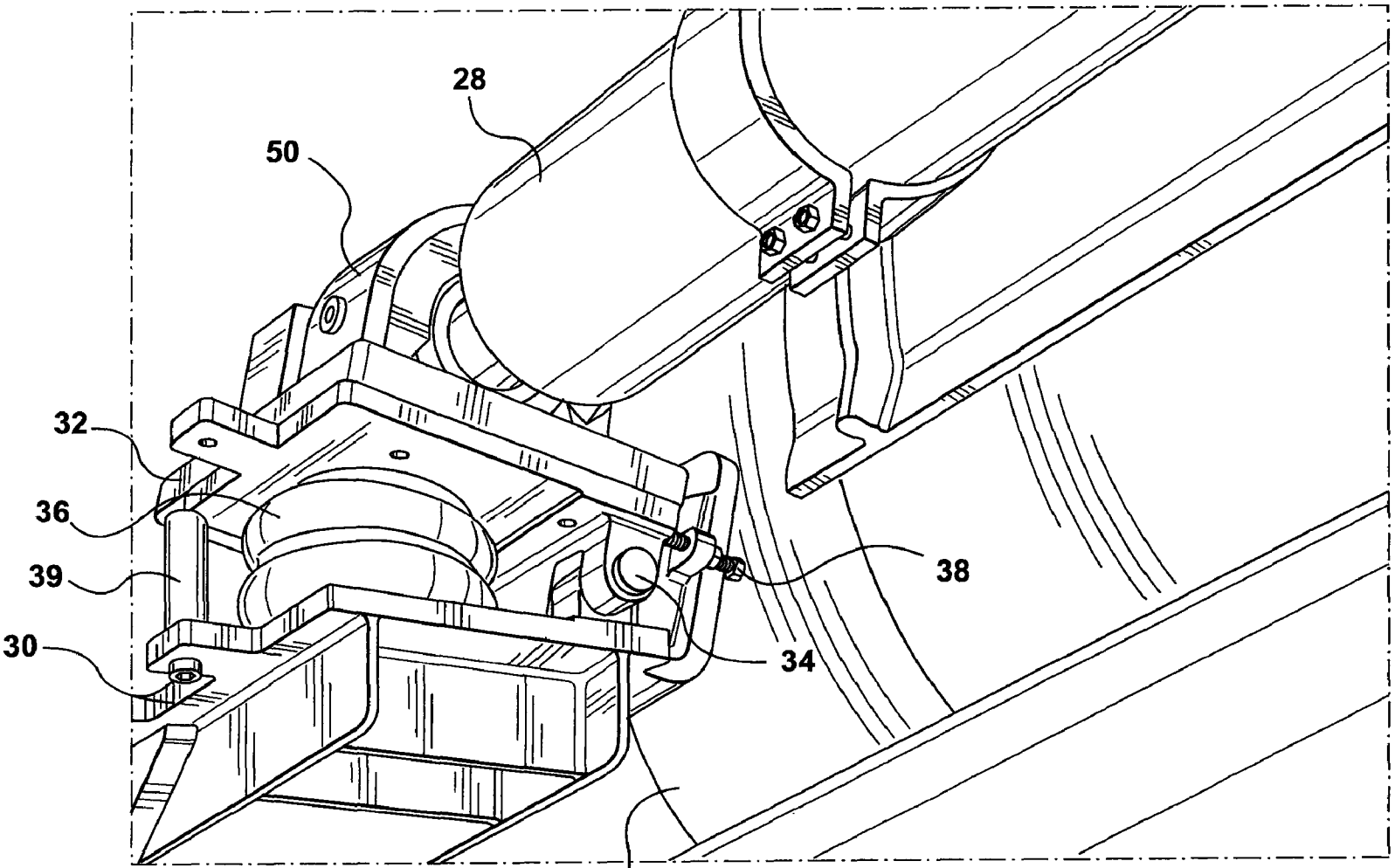
FIG. 1*e* is an enlarged perspective view of a detail of the near end of the roll assembly of FIG. 1*c;*

Block 46 may have an upper portion 45 and a lower portion 47. Those portions may be held in place by mounting fittings, which may be in the nature of bolts. The bolts may be secured by quick release fasteners, such as nuts or wingnuts. Block 46 may have a first keyway position 41, which, in the example, may be at about the 12 o'clock or top position, and a second keyway position, 43, which may be located at some other angular location, be it, for example, about 90 degrees away such as the 3 o'clock position in FIG. 1*c*. (or, looking from the other direction, 9 o'clock in FIG. 5*a*). When maintenance of assembly 22 is required, such as, for example, to change a roll engagement interface member, which may be a pad such as pad 92, discussed below, the operator may find, or place, carrier 28 in the "away" position. The upper portion 45 of block 46 may be removed by releasing the quick release fasteners 49. This permits the operator to rotate assembly 22 on shafts 42 of carrier 28 from a first position, corresponding to the 12 o'clock position of key 48, for example, to a second position, which may correspond to the 3 o'clock position of key 48. Assembly 22 may include a handle 51, such as may be attached to carrier 28, to facilitate this movement. The second position may be termed an inoperative, or maintenance position. In the 3 o'clock position, the interface engagement assembly (such as item 60, discussed below) may present the pad in an upwardly facing, relatively convenient orientation, such that the operator may pull off the old pad, and install a new pad. Once the new pad has been installed, the assembly may be returned to the 12 o'clock position, the upper portion 45 of block 46 replaced and re-secured in position, and operation of apparatus 22 may re-commence.

Figure 4A:
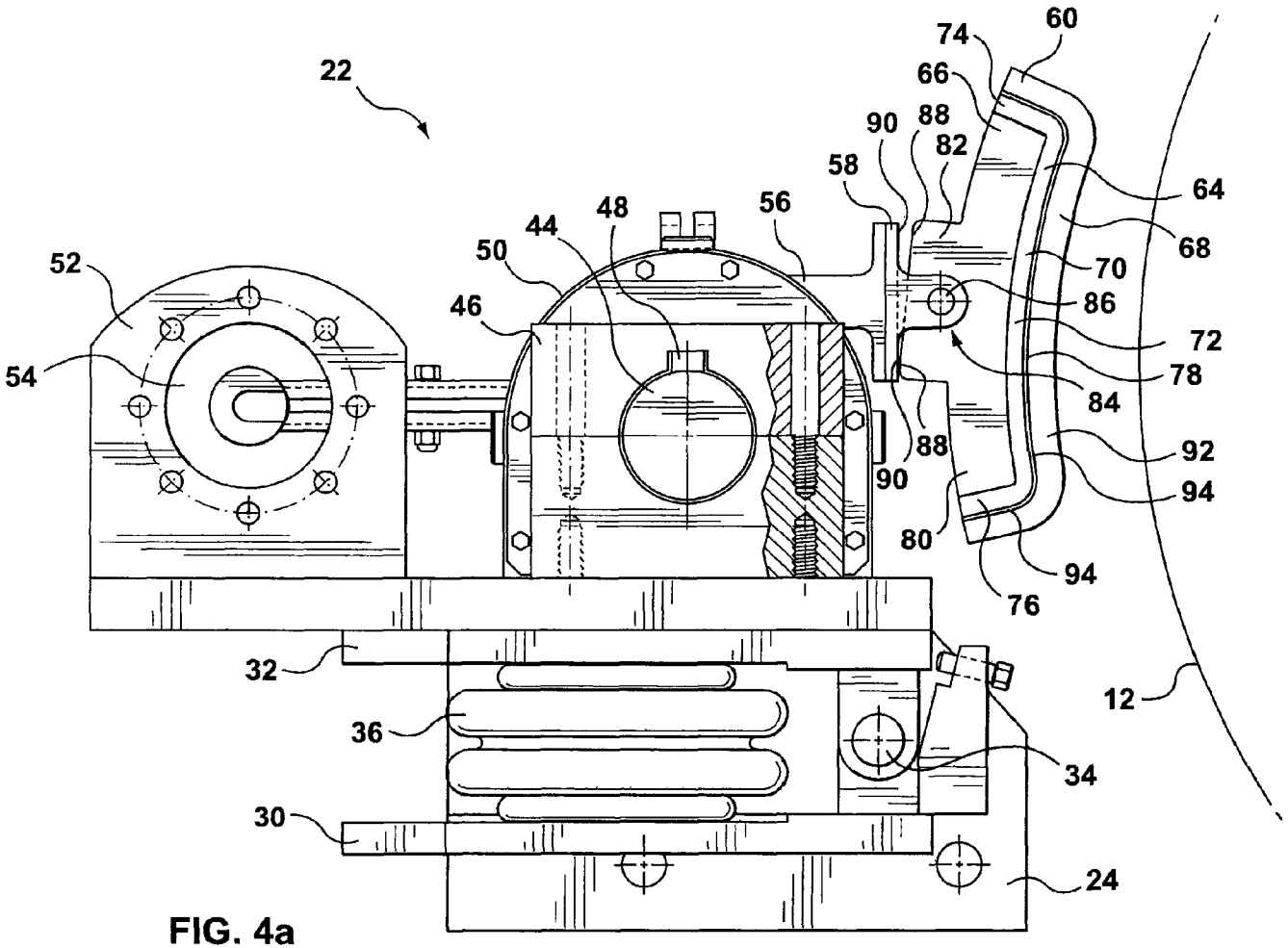
FIG. 4*a* shows an end view of an alternate cleaning apparatus to that of FIG. 3*a;*
Figure 4B:
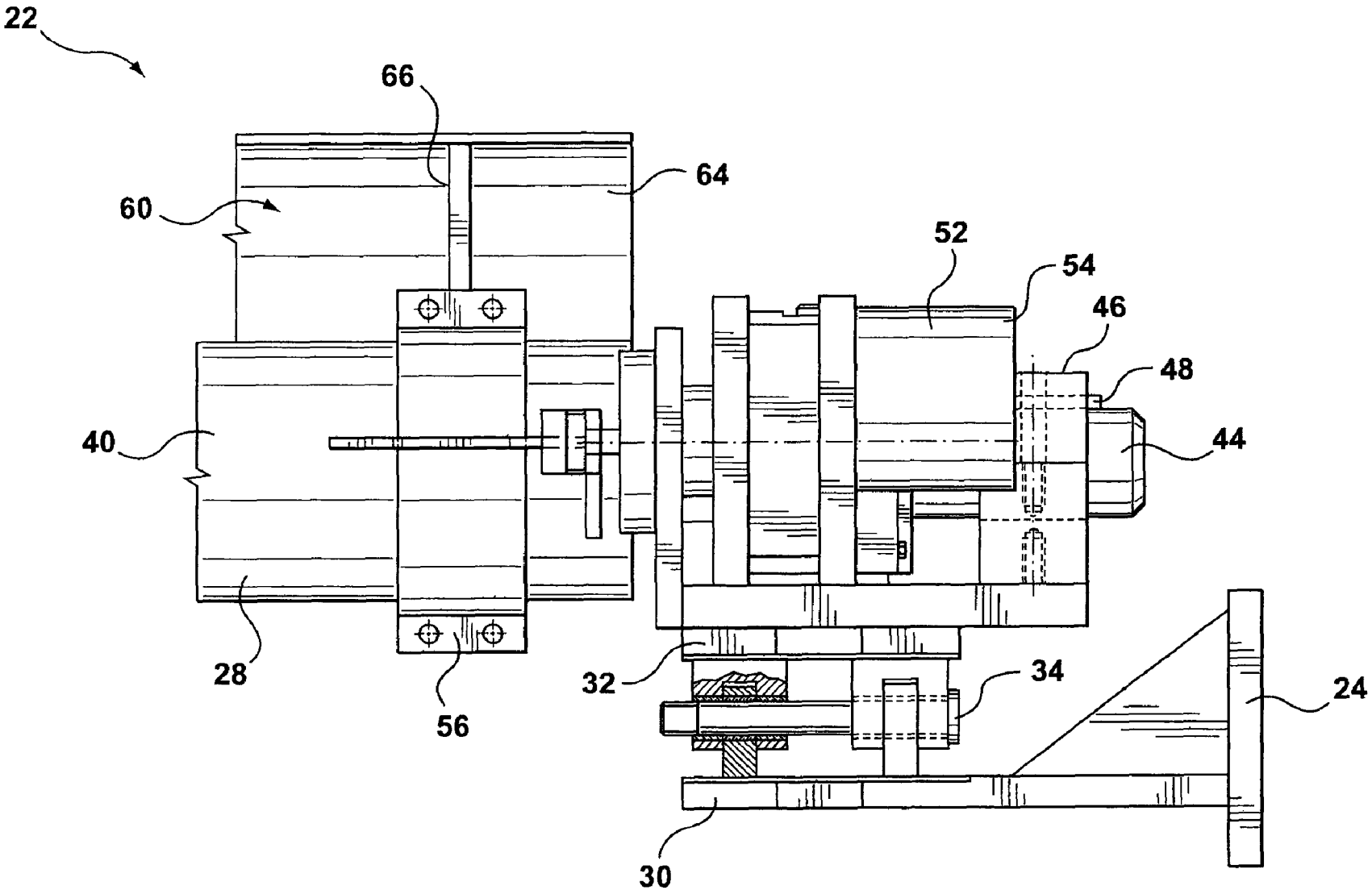
FIG. 4*b* is a elevation of the apparatus of FIG. 4*a* taken on arrow '4*b*'.
Figure 4C:
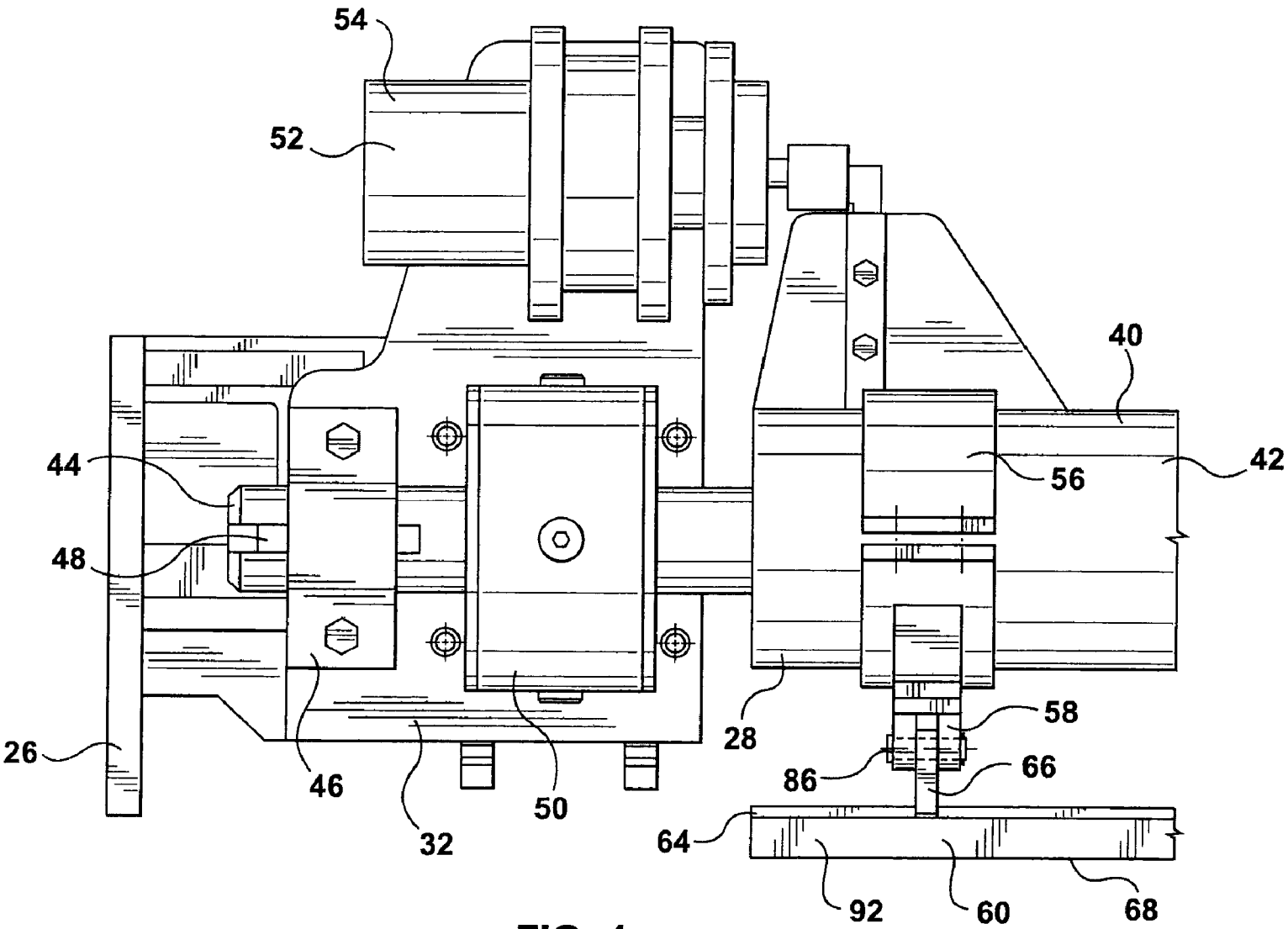
FIG. 4*c* is a plan view of the apparatus of FIG. 4*a*, taken on arrow '4*c*'.
Figure 5B:
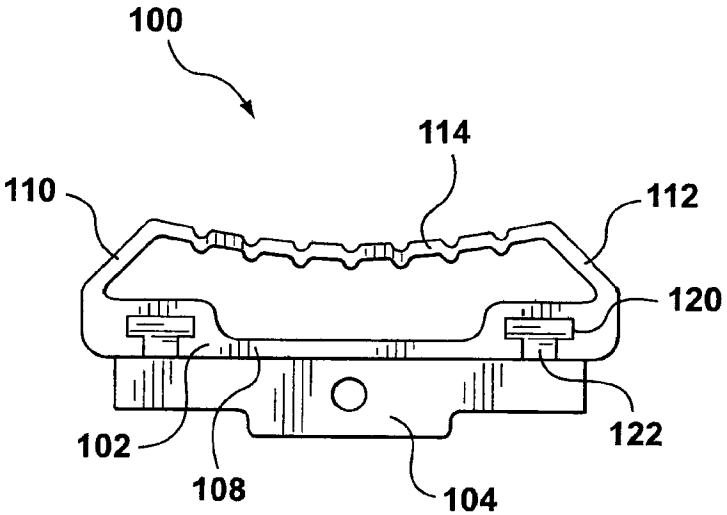
FIG. 5*b* shows an enlarged detail of a cleaning head assembly of the apparatus of FIG. 5*a;*
Figure 5A:
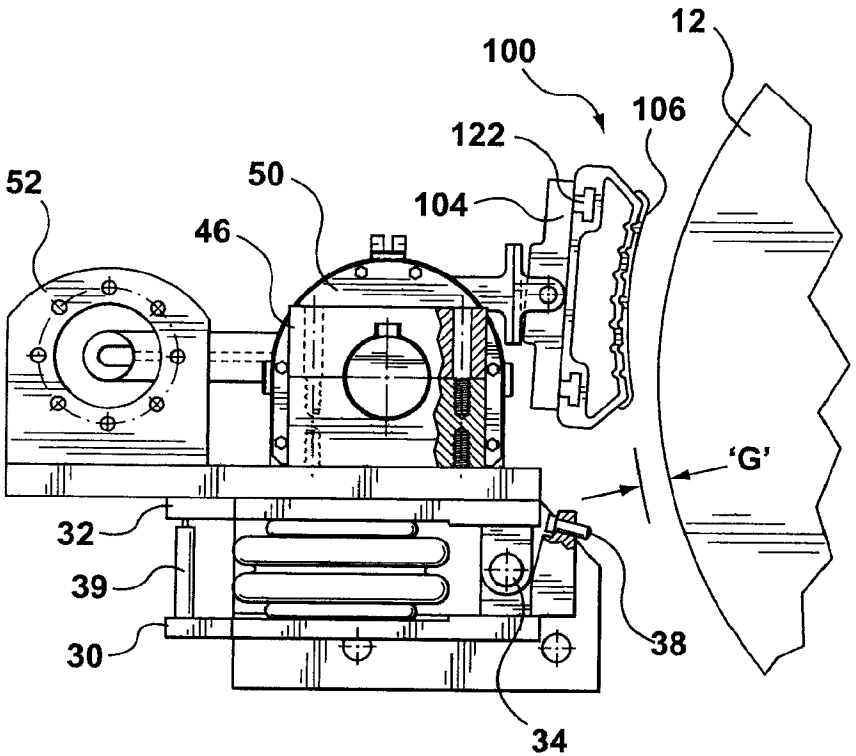
FIG. 5*a* shows an end view of an alternate apparatus to that of FIG. 5*a;*

As shown in the embodiments of FIGS. 4*a* and 5*a*, a longitudinal motion drive, such as may tend to urge, cause and govern longitudinal displacement of carrier 28 relative to bearings 50, and hence to the axis of roll 12, may be indicated generally as 52. Longitudinal motion drive 52 may be a reciprocating drive, and may be identified as an oscillator 54. Drive 52 is rigidly mounted to movable plate 30 and acts on a bracket mounted to beam member 40, to cause it to reciprocate along the shaft in a uniform periodic motion. Oscillator 54 may be air driven.

Carrier 28 may support an array of brackets 56. The members of this array of brackets may be spaced on relatively even pitches along the length of the carrier 28. Brackets 56 extended toward roll 12 and support at their distal end a cleaning member such as may be identified as cleaning head assembly 60. Brackets 56 may each include a hinge fitting 58, those hinge fittings being aligned along a common axis of rotation parallel to the axis of rotation of roll 12.

Cleaning head assembly 60 may include a backing member 64, backing member support fittings 66, and a work surface contacting member, or assembly 68. The backing member 64 may have the form or a longitudinally extending beam, such as a channel member 70. Channel member 70 may have a web portion 72 and flanges 74, 76 oriented to extend from either side of web portion 72 and substantially radially away from roll 12. It may be that web portion 72 has a surface 78 facing predominantly toward roll 12. Web portion 72 may be formed on an arcuate contour such as may tend to yield a concavity having a radius of curvature generally conforming to the curvature of roll 12. Mounting members, or support fittings 66 may include brackets 80 and, may be mounted to the radially outwardly facing side of channel member 70 at spacings corresponding to the pitch spacing of brackets 56. At the outermost extremity or stem 82 of each bracket 80 there may be a pivot fitting 84 for co-operation with a pin 86 and the corresponding hinge fitting 58 (and which may include suitable bushings or other standard hardware). It may be that the distal end of stem 82 has abutments 88 that may interact with shoulders 90 of hinge fittings 58 to limit angular motion of channel member 70 relative to carrier 28 about the axis of the hinge fittings 58.

Backing member 64 may be termed a shoe, mounted for co-operation with roll 12. A pad 92 such as may be used for engagement of the surface of the roll 12 may be secured to overlie surface 78, and thus to form a lining of the shoe defined by backing member 64. Pad 92 may have a thickness, t, and a relative softness, that may tend to provide a cushion against the outside of roll 12. When biased against roll 12 by the action of a biasing member, such as pneumatic bellows 36, pad 92 may tend to provide a contact interface continuously along the length of the outer circumferential surface of roll 12. The rotation of roll 12 may then tend to bring every part of its outer surface into contact with pad 92 at some point during operation. Thickness t may be in the range of ½ to 1 inches. Pad 92 may subtend a modest portion of the circumference of roll 12. That portion may be in the range of 5-45 degrees of arc, and may, in one embodiment, subtend about 15-35 degrees of arc. Alternatively, the width of pad 92, measured as a chord of the subtended arc, may be in the range of about 2 to about 12 inches, an in one embodiment may be about 4-8 inches, and may be about 6 inches. Pad 92 may tend to be flexible, or compressible, in the radial direction, and may tend to have a two-dimensional contact area (that is, contact defined be a patch having both an axial and a circumferential extent) over a significant area, as opposed to a rigid, (i.e., by comparison, substantially unyielding) doctor blade such as may tend to have unidimensional engagement (i.e., line contact). The limit of motion under this biasing may be established by the setting of stop 38.

In one embodiment, pad 92 may be formed from an abrasive scouring material such as a nylon mesh, having an abrasive high strength aluminium oxide or silicon carbide impregnation. Alternatively, it may be a cloth having a fine abrasive surface. Two commercially available products are Scotch Brite (t.m.) manufactured by 3M, and Beartex (t.m.) manufactured by Norton. Other similar products may also be used. Pad 92 may be secured to the surface of the shoe, that is, backing member 64, by securement fittings, or fastenings. In one embodiment, those securements may be in the form of co-operating male and female hook and loop fasteners, indicated as 94, such as those sold under the trademark Velcro, mounted to the front, or radially inward, face of backing member 64. In one embodiment, the components of hook and loop fastener 94 are formed from a stainless steel and capable of operation at elevated temperatures, which is to say temperatures in excess of 180 F, over an extended period of time.

In the alternative embodiment of FIGS. 5*a* and 5*b*, assembly 60 may be replaced by alternate assembly 100. Alternate assembly 100 may include a longitudinally running backing member 102 that is supported at spaced intervals by brackets 104 mounted on corresponding pitches, and for co-operation with, brackets 56 in the same, or substantially the same, manner as brackets 56. Assembly 100 may have a roll engagement interface member. In one embodiment that roll engagement interface member may have the form of a two dimensional array, or pad, such as may be identified as scrubbing element 106. Scrubbing element 106 may have a roughness the same, or comparable to, that of the other embodiments herein described, and may employ Scotch Brite or Beartex or such other materials as noted above. Scrubbing element 106 may be in the form of an abrasive grid or mesh of metal, or metal treated nylon, and may be such as to permit removal and washing, or removal and reconditioning, or removal and replacement as may be appropriate. Scubbing member 106 may include a sheet or abrasive cloth. In operation, the biasing of bellows 36 may tend to maintain scrubbing member 106 in contact with roll 12 over a circumferential arc and under a substantially two dimensional (longitudinal and circumferential) pressure field in which the pressure field acts substantially radially inward with respect to roll 12, as the manner noted above.

The longitudinal pad carrier, or scrubbing element carrier, namely backing member 102, may be in the form of a hollow section member, as indicated by the somewhat D-shaped section illustrated in FIG. 5*b*. This section may have a longitudinally running web or back 108 for releasable connection to brackets 104, and legs 110, 112 extending from back 108 toward roll 12 (as deployed in use). Member 102 may also have a front, or roll engagement side or face, or portion 114 extending between legs 110, 112. Portion 114 may have a form, or concavity, generally conforming to the outside radius of roll 12. Portion 114 may include relief or indexing features 116 such as may engage or retain scrubbing element 106. Portion 114 may have a flexing capacity to conform to roll 12. Backing member 102 may be formed as an extrusion, and may be formed of Aluminum. T-shaped slots 120 may be formed in back 108, such as to admit corresponding securement fittings 122 by which member 102 may be connected to brackets 104.

Figure 5C:
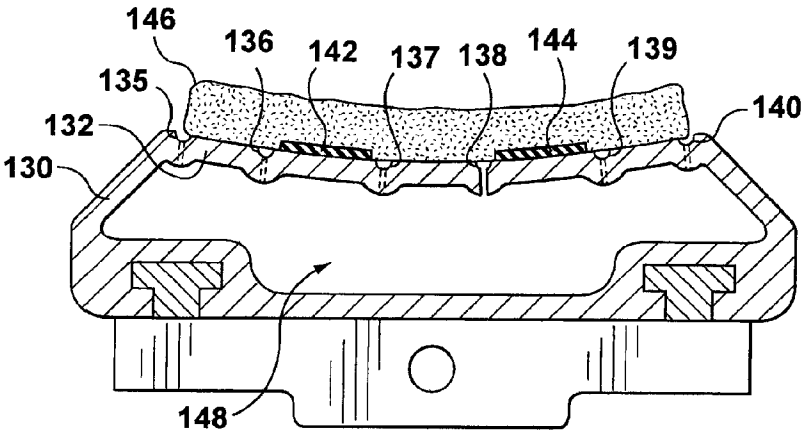
FIG. 5*c* shows a side view of an alternate cleaning head assembly to that of FIG. 5*a*.
Figure 5D:
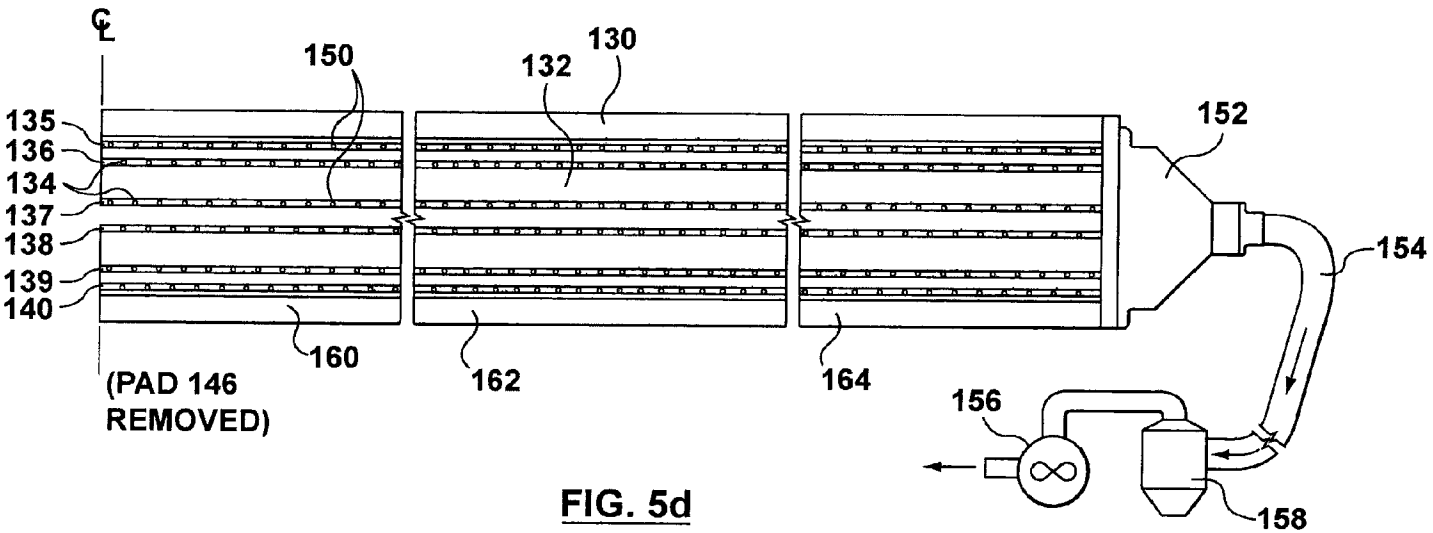
FIG. 5*d* shows a front view of part of the cleaning head assembly of FIG. 5*c*.

In the further alternate embodiment of FIGS. 5*c* and 5*d*, which may be in other respects the same as, or similar to any of the other embodiments described herein, a backing member 130 (otherwise similar to backing member 102), may be a plenum. That is, member 130 may have a roll engagement wall 132 having an array of lengthwise running grooves 134. Array 134 may include a first pair of grooves 135, 136 toward one edge, a second pair of groves 137, 138 generally centrally located along the arcuate face, and a third pair of grooves 139, 140 located near the other edge of the arcuate engagement face. Hook and loop attachment strips 142, 144 (such as Velcro), may be mounted between the first and second, and second and third pairs of grooves and may be used to provide a releasable securement of the roll engagement member, that member being a pad 146, generally similar to pad 92.

The grooves of array 134 may be provided with a pattern of apertures, or vents, or slots, inlets, or openings 150, such as to permit air to be drawn from the region of pad 146 into the internal plenum of backing member 130 indicated generally as 148. For example, backing member 130 may be capped at one end, and a vacuum line attached to the other end. Alternatively, a plenum outlet fitting, which may be in the nature of a header fitting 152, may be attached to both ends of backing member 130 to permit air extraction at both ends, which may occur in a generally symmetrical manner. A suction hose 154 may be connected between header fitting 152 and a vacuum pump, or blower or extracter indicated as 156. A filtering, or settling apparatus 158 may also be employed.

In this way, backing member 130 may define an exhaust manifold through which air may be extracted through pad 146. This air may tend to carry away dust and lint particles, and may provide ventilation to pad 146 more generally.

Openings 150 may be unequally distributed. That is to say, in a region 160 far from the header fitting 152, which region may be a region near the center of backing member 130, the number of openings may be relatively large, or the size of the openings may be relatively large, such as to permit a generally low resistance to air flow. In an intermediate region 162, the size or number, or both, of openings 150 may be somewhat smaller, and may present somewhat greater impedance to airflow. In an end region 164 close (i.e., proximate) to header fitting 152 openings 150 may be somewhat smaller and fewer again, and may be more widely spaced. The transition from a high density of openings to a low density of openings may be continuous, or may involve discrete changes of regime. Openings 150 may be staggered from row to row, such that a slot in groove 135 may be offset from a slot in groove 136, and so on. The slots in groove 135 may be partially occluded and partially exposed relative to the edge of pad 146. The slots in groove 140 may be partially occluded and partially exposed by the other edge of pad 146. The size, aspect ratio (length v. width), number, and spacing of openings 150 may vary according to the operating parameters of the assembly.

In operation, the roll cleaning apparatus, or scrubbing device may initially be in a rest position away from the surface of the roll 12. That is to say, in that 'away' position, pad 92 may rest clear of roll 12, and there may be a clearance gap 'G' therebetween. In this 'away' position pad 92 may be installed, or replaced from time to time, as may be required should the working surface of pad 92 become worn or clogged. Pad 92 may also be moved to the 'away' position in the event that the paper web running through nip 16 should break.

Once a web of material, such as a web of paper, has been fed through nip 16 successfully, and the calendar rolls are turning at speed, pad 92 may be moved from the first, away, position to a second, engagement position, in which pad 92 bears against the outer circumferential surface of roll 12. This motion from the first position to the second position may be driven by a biasing member, or drive member, such as through the application of greater pressure to bellows 36. This may tend to cause displacement of plate 32, as by pivoting movement about pin 34, with a radial component of displacement (relative to roll 12) being imparted through carrier 28 and backing member 64 to pad 92, causing it to move radially closer, and thereby into contact, with roll 12. This may tend to cause pad 92 to be brought into engagement with the surface of roll 12 and, under that biasing or urging, for pad 92 to conform to the surface of the roll 12. Pad 92 may pivot about the pivot pin 86 to find an equilibrium position. That is to say, the rotational degree of freedom afforded by the hinge fitting at pin 86 may tend to permit pad 92 to be self centering. In the event that the workpiece web, such as a web of paper, should tear or break during operation, pad 92 can be retracted relatively quickly, as noted above.

Upon engagement with roll 12, the abrasive surface of pad 92 may tend to clean the surface of roll 12. During this engagement, carrier 28, and hence pad 92, may be caused to move axially (that is in the longitudinal direction parallel to the axis of rotation of roll 12) under the urging of a longitudinally operable drive 52, such as oscillator 54. It may be that the drive member may be used to yield a linearly reciprocating motion, and that linearly reciprocating motion may be a periodic oscillation. For example, in one embodiment, as oscillator 54 acts on the beam member 40, the shaft 42 is displaced axially within the trunnion 46 but supported by the bearing block 50. The key 48 in the shaft 42 inhibits rotation of the shaft relative to the mounting plates and thus permits the transmission of a moment to hinge fittings 58. This moment may tend to yield a force at the pivot pin, that force having a component tending to compress pad 92, and tending to maintain the shoe in contact with the roll. This may tend to result in a sinusoidal path being traced out on the surface of roll 12 as roll 12 revolves.

It may be that the rate of linear oscillation of beam member 40 may be a function of the rate of revolution of roll 12. It may be that the period of oscillation is chosen to be a non-harmonic of the angular velocity of roll 12. For example, the rate of oscillation may be a non-integer fraction of the angular velocity, and may be in the range of 1-10 cycles per minutes. In one embodiment it may be about 3 cycles per minute. The amplitude of oscillation may be proportional to either the arc subtended by pad 92 or to the radius of roll 12. For example, the amplitude of oscillation may be in the range of 1/20 to 1/2 of the arc length subtended by pad 92. Alternatively, the oscillation may be in the range of 1/10 to 1/3 or the radius of roll 12. In one embodiment, the amplitude may be about 1 inch from a central, at rest position, giving a total range of axial motion of about 2 inches from one extreme to the other.

It may be that the relatively large contact area between the abrasive surface of pad 92 and the roll 12 may provide cleaning of the entire roll surface (or of such width or roll 12 as may engage the web workpiece). The oscillation of pad 92 in the axial direction may tend to deter streaking on the surface of the roll.

Various embodiments of the invention have been described in detail. Since changes in and or additions to the above-described best mode may be made without departing from the nature, spirit or scope of the invention, the invention is not to be limited to those details but only by the appended claims.

I claim:

1. A cleaning head for cleaning a roller while rotating, the cleaning head comprising:

a hollow body having a surface for directing toward the roller;

a scrubbing pad mounted on the surface;

one or more inlets defined in the surface for allowing air and debris removed from the roller by the scrubbing pad to be drawn through the scrubbing pad and the surface and into the body; and, one or more mounts for coupling the body to a drive apparatus for pressing the surface and hence the scrubbing pad against the roller;

wherein the scrubbing pad is compressible between the surface and the roller.

2. The cleaning head of claim 1 wherein the surface has a concavity conforming to that of the roller.

3. The cleaning head of claim 1 wherein the surface has one or more grooves formed thereon through which air may be drawn into the one or more inlets.

4. The cleaning head of claim 1 wherein the body has an outlet for exhausting the air and debris drawn into the body.

5. The cleaning head of claim 1 wherein the one or more mounts are pivots allowing the cleaning head to pivot toward and away from the roller.

6. The cleaning head of claim 1 wherein the scrubbing pad is an abrasive pad.

7. The cleaning head of claim 1 wherein the scrubbing pad allows air and debris to be drawn there through.

8. The cleaning head of claim 1 wherein the scrubbing pad is an abrasive impregnated mesh.

9. The cleaning head of claim 1 wherein the roller is a roller in a printing machine.

10. The cleaning head of claim 1 wherein the scrubbing pad has a thickness of at least one half inch.

11. The cleaning head of claim 1 wherein the scrubbing pad conforms to the surface.

12. The cleaning head of claim 1 wherein the scrubbing pad has a limited size substantially conforming to that of the surface.

13. The cleaning head of claim 4 and further comprising a vacuum for drawing air and debris through the scrubbing pad, the one or more inlets in the surface, the body, and the outlet.

14. A cleaning head for cleaning a roller while rotating, the cleaning head comprising:

a backing member having a surface for directing toward the roller; and, a scrubbing pad mounted on the surface;

wherein the surface and hence the scrubbing pad are configured to be pressed against the roller; and, wherein the scrubbing pad is compressible between the surface and the roller.

15. The cleaning head of claim 14 wherein the surface has a concavity conforming to that of the roller.

16. The cleaning head of claim 14 wherein the scrubbing pad is an abrasive pad.

17. The cleaning head of claim 14 wherein the scrubbing pad is an abrasive impregnated mesh.

18. The cleaning head of claim 14 wherein the roller is a roller in a printing machine.

19. The cleaning head of claim 14 wherein the scrubbing pad has a thickness of at least one half inch.

20. The cleaning head of claim 14 wherein the scrubbing pad conforms to the surface.

21. The cleaning head of claim 14 wherein the scrubbing pad has a limited size substantially conforming to that of the surface.

* * * * *